United States Patent [19]

Kobayashi

[11] 3,951,736

[45] Apr. 20, 1976

[54] SINGLE-LAYER AND MULTI-LAYER PAPER MAKING APPARATUS

[76] Inventor: Tadashi Kobayashi, 1560-2 Tenma, Fuji, Shizuoka, Japan

[22] Filed: Dec. 30, 1974

[21] Appl. No.: 537,314

[52] U.S. Cl. ..... 162/274; 162/299; 162/301; 162/306; 162/DIG. 7

[51] Int. Cl.[2] ..... D21F 9/04; D21H 1/06

[58] Field of Search ..... 162/299, 300, 301, 303, 162/304, 306, 351, 352, 132, 133, 203, 211, 274, DIG. 7

[56] References Cited

UNITED STATES PATENTS

| | | | |
|---|---|---|---|
| 3,485,715 | 12/1969 | Kobayashi | 162/304 |
| 3,625,814 | 12/1971 | DeNoyer | 162/299 |
| 3,726,758 | 4/1973 | Parker et al. | 162/299 |
| 3,772,140 | 11/1973 | Kobayashi | 162/304 X |
| 3,795,576 | 3/1974 | Watanabe | 162/203 X |

*Primary Examiner*—S. Leon Bashore
*Assistant Examiner*—Richard V. Fisher
*Attorney, Agent, or Firm*—George B. Oujevolk

[57] ABSTRACT

A paper making apparatus for producing sheets of paper at speeds in excess of 200 m/minute. A breast roll and a wire cage turning cylinder are disposed above and below a forming roll. The forming roll is a hollow roll having a smooth surface. A belt passes in an S-shape over the forming roll and turning cylinder and a wire belt passes over the breast roll, forming roll and turning cylinder. The head box discharges raw material between the wire belt and the S-shaped belt, and a web is formed along the circumference of the forming roll over an angle of about 100°. A web pick-up device is provided under the turning cylinder to separate the formed web from the wire belt.

2 Claims, 3 Drawing Figures

SINGLE-LAYER AND MULTI-LAYER PAPER MAKING APPARATUS

BACKGROUND OF THE INVENTION

The present invention relates to an improvement in single-layer and multi-layer paper making apparatus.

BRIEF DESCRIPTION OF THE PRIOR ART

Conventional types of single-layer and multi-layer paper making apparatus for forming single-ply and multi-ply webs of paper by holding fluidal stock of paper between an endless belt composed of wire or felt and rolls over which the belt is mounted and removing water from the stock lying on the roll surface by the centrifugal force of the rolls and by the suction into the roll inside are already known.

For instance, there is the apparatus covered by U.S. Pat. No. 3,485,715 shown in FIG. 3 hereof. This apparatus is effective when the paper making speed is 200 m/min. or below. When the speed is higher than this, a part of the wire water, i.e., water on the wire, collected in wire cylinder 1 rises along the inner periphery of wire cylinder 1 by centrifugal force without being adequately drained from the lower part of the cylinder inside through the drain port and is ejected from the cylinder inside to the part adjacent to the nip outlet N formed by wire cylinder 1 and couch roll 2. As the ejected wire water is conveyed by belt 3 together with the web, the wire water splashes over the web layer on wire cylinder 1' by the centrifugal force of guide roll 4' of the paper making unit at the next stage and disfigures the formation of paper, making it impossible to produce multi-layer paper at high speed. The tendency of this defect becomes more pronounced when the paper making speed is increased beyond 200 m/min.

OBJECT OF THE INVENTION

It is therefore the chief object of the present invention to improve known paper making apparatus such as the one described above so as to increase the economic effects in the manufacture and operation of this kind of apparatus and to enable the production of single-ply and multi-ply webs in paper-making processes at speeds about 200 m/min as well as at lower speeds without wrinkling or crushing the formation of paper.

SUMMARY OF THE INVENTION

This invention has achieved the above object by arranging a breast roll and a turning cylinder consisting of a non-suction wire cylinder respectively above and below a forming roll consisting of a hollow roll having a smooth surface, mounting a belt in the shape of an S endlessly over the forming roll and turning cylinder, mounting a wire directly over the breast roll and turning cylinder, and indirectly via the belt, over the forming roll so as to form a web-forming area nearly covering half the circumference of the forming roll, providing a head box having an opening for an outlet near the point between the forming roll and the breast roll, composing a paper-making unit mainly of said various components in such a manner that the belt and wire cover nearly half the circumference of the turning cylinder and separate from each other at the point where they leave the turning cylinder and assemblying a multi-layer paper making apparatus by arranging a plurality of said paper making units horizontally.

The invention, as well as other objects and advantages thereof will become more apparent from the following detailed description when taken together with the accompanying drawings, in which.

DETAILED DESCRIPTION

Now to describe the present invention with regard to the embodiment shown in the attached drawing, forming roll 5 consists of a hollow roll having smooth surface and turning cylinder 6 consists of a wire cylinder and is provided below forming roll 5. Said turning cylinder 6 may be formed either of an ordinary wire cylinder or of a cylinder having a multitude of narrow grooves or small holes on its circumferential surface with or without wire stretched over said grooves or holes.

Breast roll 7 arranged above forming roll 5 consists of a hollow roll.

Figure 1:
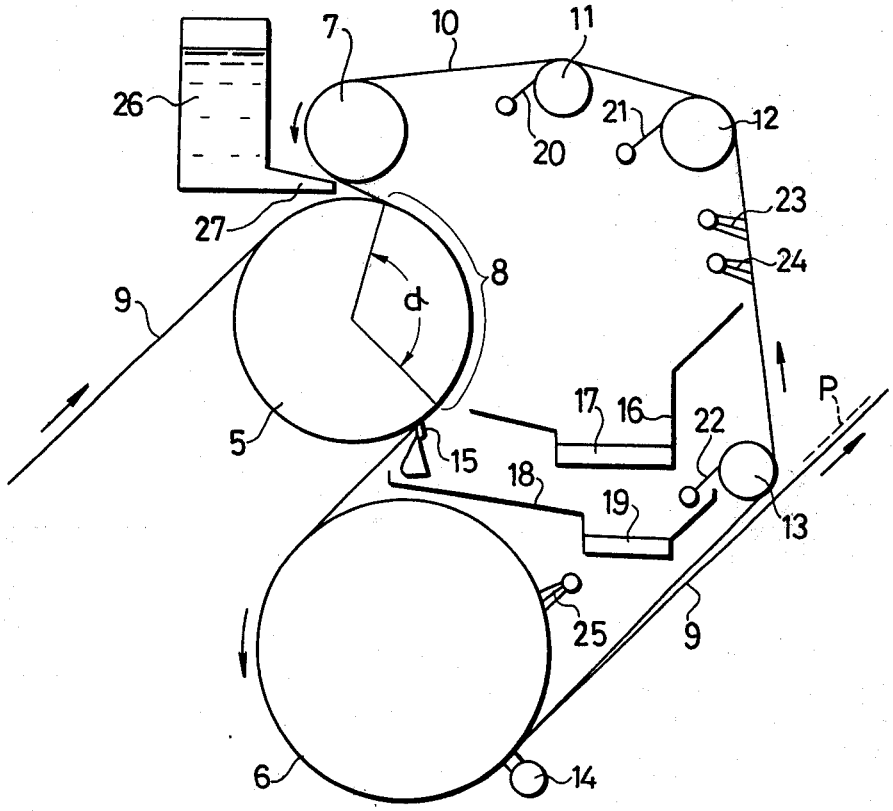
FIG. 1 is a diagrammatic side view of a single-layer paper making apparatus embodying this invention.

As shown in FIG. 1, endless belt 9 consisting of felt or wire is mounted over forming roll 5 diagonally from lower left and descends. Then said belt 9 is mounted over turning cylinder 6 via endless wire 10 and extends diagonally upwards toward the upper right.

Wire 10 directly contacts breast roll 7 and turning cylinder 6 and is then mounted over forming roll 5 via belt 9. Said wire 10 is supported on its inside by guide rolls 11, 12 and 13.

That portion of the circumferential surface of forming roll 5 which is contacted simultaneously by belt 9 and wire 10 is web-forming area 8. This web-forming area 8 must be large enough to cover nearly one half of the circumference of forming roll 5, that is angled must be at least 100°, so that the stock can be held between belt 9 and wire 10 and dehydrated by the pressure and centrifugal force of wire 10 and forming roll 5.

Belt 9 mounted over turning cylinder 6 separates from wire 10 and proceeds diagonally upward after traveling along nearly half the circumference of turning cylinder 6. At the point where belt 9 separates from wire 10 there is provided web pick-up device 14.

Deflector 15 is provided on the inside of wire 10 at a location a little below the lower end of web-forming area 8 of forming roll 5. Water receiving plates 16 and 18, save-all units 17 and 19, and drain boards 20, 21, and 22 are provided respectively near guide rolls 11, 12 and 13. Shower devices 23 and 24 are provided near wire 10 and shower device 25 is provided near turning cylinder 6.

Head box 26 has stock (slurry) outlet 27 facing the space between the top of forming roll 5 over which the belt 9 is mounted and the bottom of breast roll 7 over which wire 10 is mounted.

Figure 2:
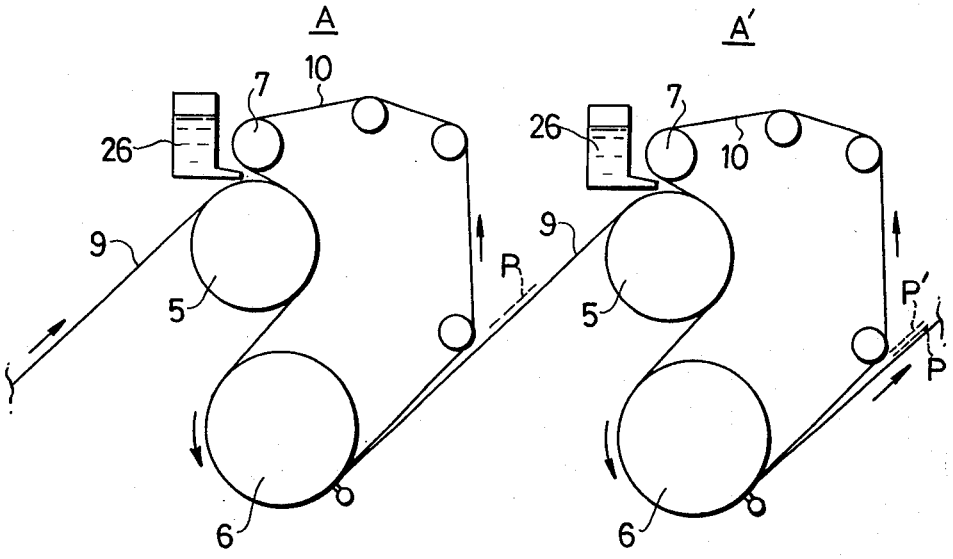
FIG. 2 is a diagrammatic side view of a multi-layer paper making apparatus embodying this invention; and, FIG. 3 is a diagrammatic side view showing the multi-layer paper making apparatus of the prior art described above.
Figure 3:
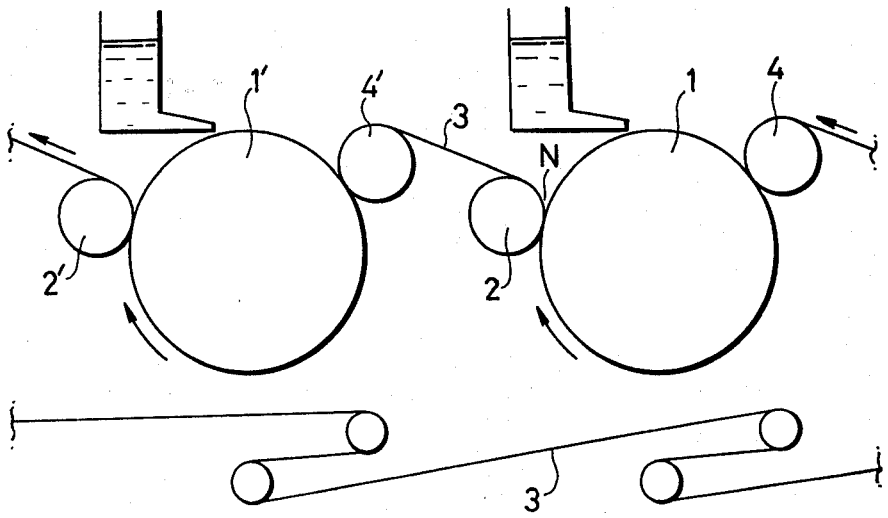
FIG. 3 PRIOR ART

FIG. 2 represents a plurality of the paper making units A and A' shown individually in FIG. 1. Said units A and A' are arranged horizontally with belt 9 mounted endlessly over their respective forming rolls 5 and turning cylinders 6 so as to compose a multi-layer paper making apparatus.

The single-layer and multi-layer paper making process according to the present invention is as follows. In FIG. 1, belt 9 and wire 10 travel at the same speed.

Paper stock fed into head box 26 through stock inlet (not shown) is let flow, in the predetermined paper width, on belt 9 between forming roll 5 and breast roll 7 through stock outlet 27 and brought in between the traveling belt 9 and wire 10. As the stock enters web-forming area 8, most part of the water contained in the stock is squeezed out through wire 10 by the pressure of forming roll 5 and wire 10 contacting each other via belt 9 and thrown off by centrifugal force into the zone surrounded by wire 10. The dropped water is received in water receiving plate 16 and drained to the outside of the unit through drain port 17.

As most part of the water is removed from the stock in web-forming area 8, a web is nearly formed. The web then travels along nearly half the circumference of turning cylinder 6, being held between belt 9 and wire 10.

Web P almost completely formed in area 8 of forming roll 5 is separated from wire 10 by pick-up device 14 at the point of the circumference of turning cylinder 6 at which belt 9 and wire 10 separate from each other. Then the web is transferred onto belt 9 to be conveyed to the next paper making unit or to the subsequent pressing process.

How webs are combined to make multi-layer paper will be described by referring to FIG. 2. Web P formed in the first paper making unit A is conveyed on belt 9 and brought into the space between forming roll 5 and breast roll 7 of the next paper making unit A′. The paper stock from head box 26 of paper making unit A′ is fed to said space so that the web formed in unit A can be combined with said stock both in web-forming area 8 of forming roll 5 of unit A′ and in the portion where belt 9 and wire 10 contact turning cylinder 6 of unit A′. Combined webs P and P′ are transferred to the subsequent pressing process. Description of this process, however, is omitted from this specification because it is not different from that of prior art.

It is a feature of this invention that, although forming roll 5 is formed of a hollow roll having smooth surface which is not in itself effective in dehydrating the stock the web-forming area 8 of said roll 5 is made as large as possible to the extent that said area 8 can cover nearly one half of the circumference of forming roll 5 so as to raise the dehydrating efficiency. This feature eventually improves economic effects in the manufacture and operation of forming roll 5 and also the effects of forming the combining webs. It is another feature of this invention that turning cylinder 6 is formed of a wire cylinder which does not cause crushing to the formation of paper, thereby improving economic effects in the manufacture and operation of turning cylinder 6.

Yet another feature of the present invention is that belt 9 and wire 10 separate from each other as soon as they leave turning cylinder 6 and that at the same time the directions of belt 9 and wire 10 are changed by turning cylinder 6 so that the finally formed web P can be transferred onto belt 9 and conveyed to the next paper making unit A′. This feature eliminates such excess water remaining on the traveling belt 9 as will have an adverse effect on the combination of webs in paper making unit A.

In a practical embodiment, the forming roll 5 and turning cylinder 6 have respective diameters of 48 inches for the forming roll, 60 inches for the cylinder and the distance from the center-points between the forming roll 5 and cylinder 6 is 5 feet, 7 inches.

The most suitable embodiment of the present invention has been described so far by referring to the attached drawing. It will be obvious to those skilled in the art that various changes may be made in the design without departing from the spirit of the invention, and therefore, the invention is not to be limited to what is shown in the drawing and described in the specification, but only as defined in the appended claims.

I claim:

1. A paper making apparatus for producing elongated sheets of paper at speeds in excess of 200 m/minute, comprising in combination:

a. a head box (26) for feeding paper-making slurry from a narrow elongated horizontal outlet (27) in one direction;

b. a large diameter rotating hollow forming roll (5) having a smooth surface with an axis of rotation disposed vertically substantially under said outlet (27) the roll having a periphery extending to said outlet and receiving slurry material discharged substantially tangentially thereon at the upper part of said roll, said roll being adapted to rotate in the same direction as the slurry discharged thereon;

c. a large diameter rotating hollow turning cylinder (6) so disposed that its axis of rotation is almost vertically under said forming roll (5);

d. a rotating breast roll (7) disposed over said outlet so that said elongated horizontal outlet (27) extends partly between said rotating breast roll (7) and said forming roll (5);

e. an endless wire belt (10) passing over said breast roll (7) in front of said outlet (27) traveling at the time of passing substantially in the same direction as said slurry fed from said outlet, said wire belt traveling over the periphery of said forming roll (5) for an angle of at least 100° of the circumference of said forming roll (5), and then, leaving said forming roll to travel in the other direction, passing to the periphery of said turning cylinder (6) and traveling over said turning cylinder periphery at least until said direction of travel is again reversed;

f. an endless second belt (9) contacting the periphery of said forming roll (5) below said forming roll upper part, traveling along said forming roll periphery between said forming roll periphery and said wire belt (10) so that said slurry is sandwiched between said wire belt at the outside and said second belt on the inside, to form a web, said second belt also traveling together with said wire belt around said turning cylinder;

g. first save-all plate means (16) disposed adjacent to said forming roll (5) extending under said roll to receive liquid squeezed from said slurry through said wire belt (10) and ejected by the rotating action of said roll (5);

h. separation means (14) disposed under said cylinder (6) to separate the formed web from said wire belt (10) and, i. a deflector (15) disposed under said forming roll (5) at the location where said wire belt (10) leaves said forming roll, and, a second save-all plate means (19) having a water receiving plate (18) extending under said deflector (15) disposed to receive additional liquid squeezed from said slurry.

2. A paper-making machine as claimed in claim 1 wherein said combination is a first unit, the formed web from said first unit traveling with said second belt to a similar second unit, said slurry from said second unit being sandwiched between a wire belt from said second unit on the outside and the web from the first unit thereunder, said second belt again being on the inside.

* * * * *